US009855646B2

(12) United States Patent
Ronconi et al.

(10) Patent No.: US 9,855,646 B2
(45) Date of Patent: Jan. 2, 2018

(54) SAFETY DEVICE FOR A NAILER

(71) Applicant: FASCO S.R.L., Granarolo Dell'Emilia (IT)

(72) Inventors: Marco Ronconi, Bologna (IT); Andrea Carati, Castelmaggiore (IT)

(73) Assignee: FASCO S.R.L. (IT)

( * ) Notice: Subject to any disclaimer, the term of this patent is extended or adjusted under 35 U.S.C. 154(b) by 626 days.

(21) Appl. No.: 14/448,034

(22) Filed: Jul. 31, 2014

(65) Prior Publication Data

US 2015/0034693 A1 Feb. 5, 2015

(30) Foreign Application Priority Data

Aug. 2, 2013 (IT) ..... BO2013A0434

(51) Int. Cl.
*B25C 1/00* (2006.01)
*B25C 1/04* (2006.01)

(52) U.S. Cl.
CPC ..... *B25C 1/008* (2013.01); *B25C 1/047* (2013.01)

(58) Field of Classification Search
CPC B25C 1/00; B25C 1/047; B25C 1/008; B25C 1/005
USPC ..... 227/8, 131, 129
See application file for complete search history.

(56) References Cited

U.S. PATENT DOCUMENTS 3,512,454 A * 5/1970 Perkins ..... B25C 1/041 227/130
3,524,576 A * 8/1970 Bader ..... B25C 1/003 227/136
3,543,987 A * 12/1970 Obergfell ..... B25C 1/003 227/136
3,549,074 A * 12/1970 Brunelle ..... B25C 1/143 227/10
3,606,128 A * 9/1971 Cast ..... B25C 1/008 227/1
4,211,353 A 7/1980 Aunis
4,313,552 A * 2/1982 Maurer ..... B25C 1/005 227/109

(Continued)

FOREIGN PATENT DOCUMENTS

FR 2825422 A 12/2002

OTHER PUBLICATIONS

Italian Search Report for corresponding Italian Application No. BO2013A 000434, completed May 20, 2014, 7 pages.

*Primary Examiner* — Andrew M Tecco
(74) *Attorney, Agent, or Firm* — Ware, Fressola, Maguire & Barber LLP

(57) ABSTRACT

A safety device for a nailer has a movable element movable between a locking condition and a release firing condition. At least one lock has a stopping end movable to engage an abutment fixed to or carried by the movable element, for stopping it in the locking condition. When disengaged, the stopping end allows translation to the release position. The lock is also provided with an elastic element which acts in the direction of the stopping condition, with an arming mechanism acting counter to the elastic element, for shifting the lock and the respective stopping end for moving to the armed condition. An operator, to put the nailer in the armed and released conditions, must act on the arming mechanism to free the abutment from the stopping end, and he must place the movable element in the release condition to shoot the nail by pulling a trigger.

14 Claims, 5 Drawing Sheets

(56) References Cited

U.S. PATENT DOCUMENTS

| | | | | | |
|---|---|---|---|---|---|
| 4,384,668 | A * | 5/1983 | Tutomu | B25C 1/008 | 173/169 |
| 4,405,071 | A | 9/1983 | Austin | | |
| 4,493,376 | A * | 1/1985 | Kopf | B25C 1/143 | 173/210 |
| 4,565,312 | A * | 1/1986 | Berry | B25C 1/105 | 227/10 |
| 4,570,840 | A * | 2/1986 | Bull | B25C 1/005 | 227/114 |
| 4,736,879 | A * | 4/1988 | Yamada | B25C 1/041 | 227/130 |
| 4,804,127 | A * | 2/1989 | Kirkman | B25C 1/143 | 227/10 |
| 4,960,188 | A * | 10/1990 | Wossner | F16F 9/061 | 188/315 |
| 6,209,770 | B1 * | 4/2001 | Perra | B25C 1/008 | 227/120 |
| 7,780,053 | B2 * | 8/2010 | Wen | B25C 1/04 | 227/130 |

* cited by examiner 35
11
33
6
37
39

3
17 R
39
9
5
27
B
7
4

35
11
33
37
39

A
27
7
S
3
21
15
17
39
9
4

SAFETY DEVICE FOR A NAILER

CROSS REFERENCE TO RELATED APPLICATIONS

This application claims priority in Italian patent application no. BO2013A 000434, filed Aug. 2, 2013, the contents of which are hereby incorporated by reference.

DESCRIPTION OF THE INVENTION

The present invention refers to the field concerning manual tools for the application of nails or similar fasteners and refers to a safety device for a nailer assigned to prevent the single-shot or repeat actuation without a voluntary enable by the user carried out before the actuation.

There are known pneumatic tools, called nailers, for the application of nails, "U" shaped points and similarly are able to fix these nails into wood and in other materials and utilized in building, in furniture, in packaging, in pallet manufacture, in the wood industry in general and in various fields.

Such known nailers are equipped with safety devices, for example of the contact kind, which prevent the operation of the nailer if its output part for the nails is not pressed against the object to be nailed. Such contact safety devices comprise a slide translating parallel to the shot direction of the nails between a protruding position with respect to the exit mouth of the nails and a retracted position in correspondence of which such mouth is adjacent to the piece to be nailed and the nailer is enabled to shoot the nail by the manual actuation of a trigger of the nailer. Such contact safety is used by operators also for the fast repetition application of the nails: the trigger then causes the shot of the nail by pressing the security slide against the part to be nailed.

One disadvantage of such contact slide safety devices consists in that if the operator, even inadvertently, holds the trigger down, the nailer will shoot the nail as soon as the slide is retracted from contact with any object including limbs or other portions of the body of the same operator or bystanders.

Prior art documents such as U.S. Pat. No. 4,405,071A, U.S. Pat. No. 3,606,128A, U.S. Pat. No. 4,211,353A and French Patent no. 2 825 422A disclose a safety device for a nailer of the type provided with actuating means for the expulsion of a nail, staple or the like in a shooting direction and having a movable element movable between a locking condition wherein the nailer is inhibited from operation and a release condition wherein the movable element does not block the nailer. In these devices, it is possible to fire the nail by actuating a trigger.

SUMMARY OF THE INVENTION

One purpose of the present invention is to propose a safety device for a nailer that allows actuation of the nailer by the trigger only after a specific action on a command of said safety device, actuated only by a direct manual intervention of the operator or only after having manually and consciously armed the nailer using the safety device.

Another purpose is to propose a device capable of inhibiting the operation of the nailer after a predetermined time span spent by the actuation of the safety device itself or from the last actuation of the nailer or rather the last shot.

A further purpose is to propose a device that allows performing fast repetition nailing using the safety slide.

Another purpose is to propose a safety device for arming the nailer by manual direct action on the drive of the safety device.

A further purpose is to propose a safety device for arming the nailer by a direct servo-assisted action on the command of the safety device.

Another purpose is to propose a safety device which can also be applied to not prearranged nailers or old type nailers.

BRIEF DESCRIPTION OF THE DRAWINGS

The characteristics of the invention are below highlighted with particular reference to the accompanying drawings in which.

DETAILED DESCRIPTION OF THE INVENTION

Figures 1, 2:
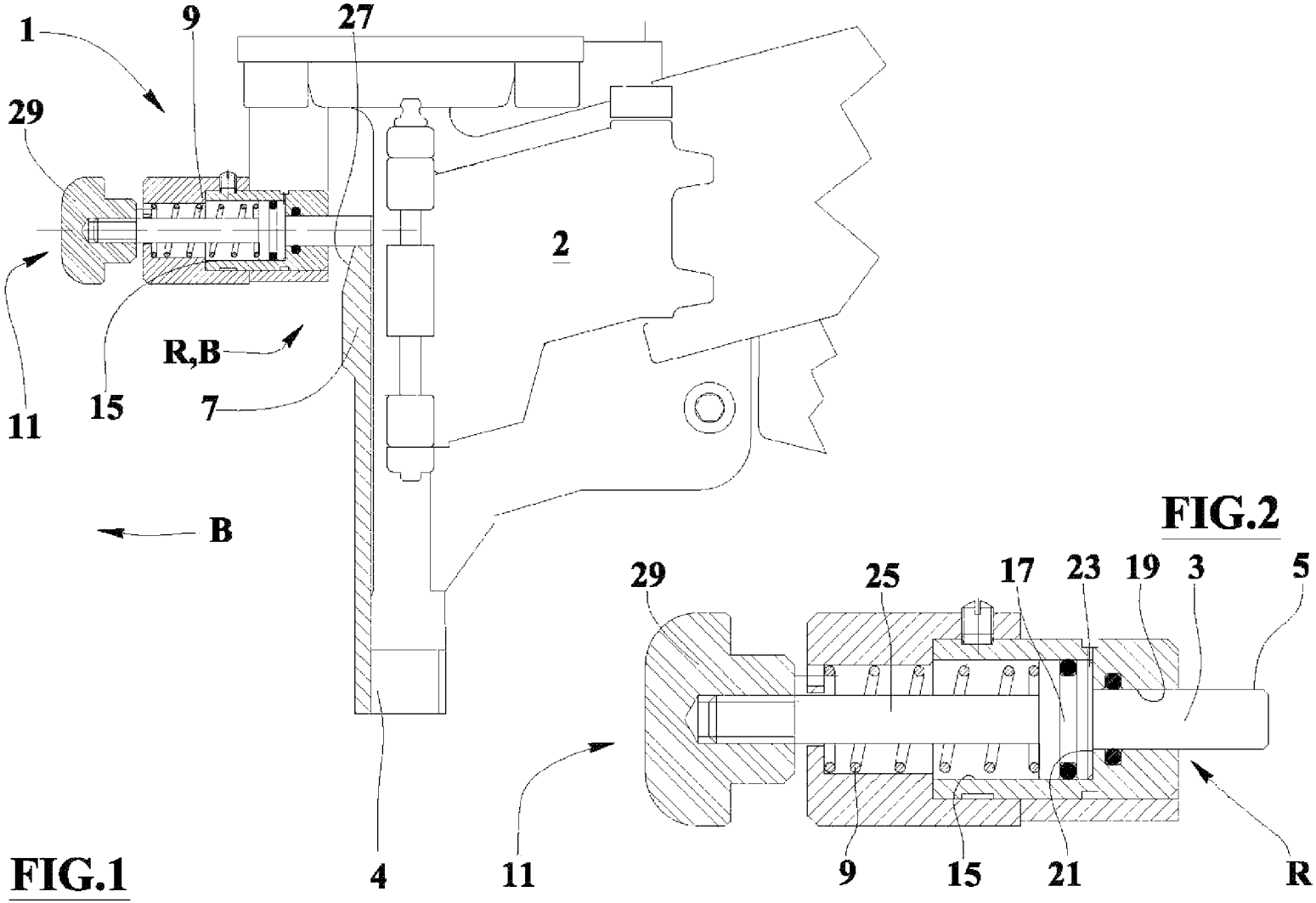
FIG. 1 shows a longitudinal section view of the safety device for a nailer, the object of the present invention, when the nailer is shown only partially and in which the device is in a locked condition of the nailer.
FIG. 2 shows an enlarged view of an element of the device of FIG. 1.
Figure 4:
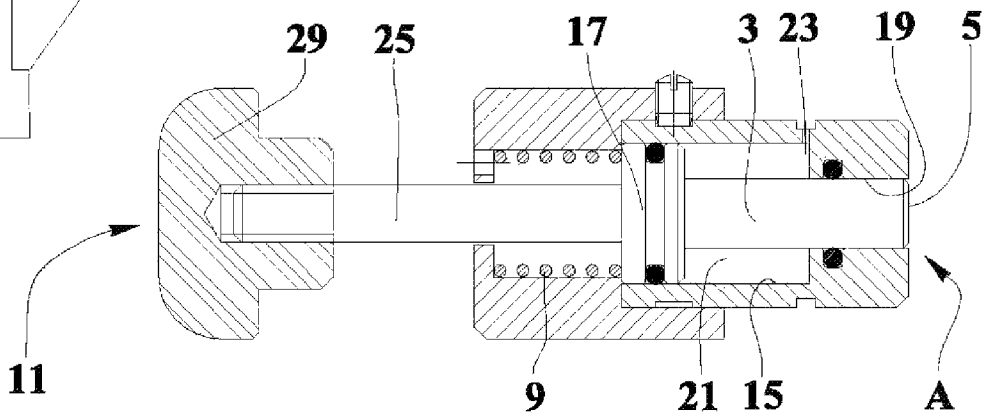
FIG. 4 shows an enlarged view of an element of the device of FIG. 3.
Figure 3:
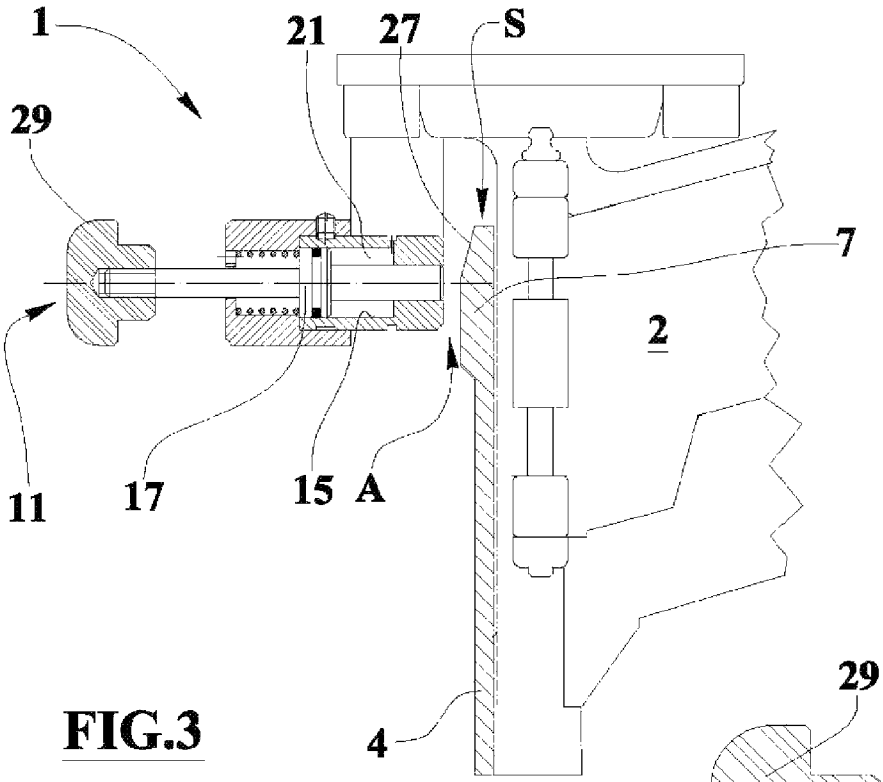
FIG. 3 shows a longitudinal section view of the safety device for a nailer, when the nailer is shown only partially, and wherein the device is in an armed condition of the nailer.

With reference to FIGS. 1-4, numeral 1 indicates the safety device for a nailer 2 which is the object of the present invention.

The nailer 2 or similar machines, also indicated with the words stapler or pneumatic fastening or fasteners for nails or fasteners of other kinds, is of the type equipped with an actuator, preferably of the pneumatic type, for the expulsion in a direction shot of a nail, clip or similar structure or the already mentioned fasteners of other species.

The nailer 2 is equipped with a movable element 4 consisting of a rod for the contact safety lock that allows shooting only when the exit mouth of the nailer is pressed against the object to be fixed by the nail.

The movable element is movable between a locking condition B in which the nailer is inhibited from operation and a release condition S, corresponding to the contact and pressure condition of the mouth with the object, wherein the movable element does not lock the nailer and in which it is possible to shoot the nail by actuation of a trigger 6 of said nailer 2.

Alternatively the invention provides that the movable element 4 may consist of a rod, a transmission element, a command valve or other drive parts, for example associated to the shot element, which, if locked in its sliding, prevents the shot.

The device 1 comprises at least one lock 3 having a stopping end 5 movable between a stop condition R and an armed condition A and vice versa.

In the stop condition R, the stopping end 5 interferes with an abutment 7 fixed to, or formed into the movable element 4, stopping the element 4 in said locking condition B, thus preventing the element 4 from assuming the release condition S and thus preventing the shot.

In the armed condition A, the stopping end 5 is moved away from the abutment 7 or at least does not interfere with the abutments movement, allowing the translation of the abutment 7 itself until reaching the release condition S in which it is possible to begin shooting. Preferably, the lock consists of a stem 3.

The lock 3 is provided with elastic element 9, for example consisting of a compressed helical spring acting on a piston 17 or on an extension 25 of the stem 3 opposite to the stopping end 5, in the direction of the stop condition R.

The device 1 also comprises an arming mechanism 11 intended to act on the extension 25 of the stem 3 or on the piston 17 in contrast to the elastic element 9 and to translate the piston 17, the lock 3 and the respective stopping end 5 when in the armed condition A.

The operator, to put the nailer in the armed A and release S conditions and then to be able to use the nailer in firing, must act on the arming mechanism 11, freeing the abutment 7 by the stopping end 5, and he must move the movable element 4 to the release condition S in which the device can shoot the nail when acting on the trigger 6.

The invention provides that the abutment 7 can be fixed to, or be incorporated into, the movable element 4, or rather be located at the end of the rod opposite to the mouth of the contact safety lock.

In this way, the abutment 7 translates together with the movable element 4 of the safety in a parallel direction to the shooting direction while the lock 3 and the respective stopping end 5 translate along a perpendicular or inclined direction with respect to said shot direction.

In more detail, the device 1 comprises a cylinder 15 in which cavity slides in a pneumatic sealed manner the piston 17 fixed to the lock 3 which serves as a cylindrical stem of said piston 17.

The stem, or rather the lock 3 slides in a pneumatic sealed manner through a passing hole 19 obtained through an end wall of the cylinder 15 or rather through the head of such cylinder.

The cylinder liner or inner wall of the cylinder can be made of steel, aluminum or another suitable material and the piston can be of aluminum or zamak alloy and can be equipped with bands or rings of the O-ring type for providing pneumatic sealing. Even the passing hole 19 may be provided with bands or rings for pneumatic sealing with the stem 3, which may be made of steel or another durable material, preferably a metallic material.

The chamber 21 of the cylinder 15 containing the stem 3 of the piston or rather limited between the piston 17 itself and the end head wall having the passing hole 19, is equipped with a vent hole 23 passing through the side wall of the cylinder and obtained near to said terminal head having the passing hole 19; alternatively it is provided that the vent hole may be carried out through the wall of the terminal head or through the stem 3 until connecting the chamber 21 in flow communication with the outside.

The vent hole 23 is calibrated or adjustable so that the elastic element 9, in pushing the piston 17 or the extension 25 of the stem 3 and translating it until the locking condition is reached, spends a certain time span inversely proportional to the force of the spring and to the vent hole 23 diameter.

The abutment 7 comprises an end, a shoulder or a protrusion assigned to abut with the stopping end 5 in the stopping condition R and comprises at least one inclined plane surface 27 which extends from said end or other and assigned to slidingly abut with the stopping end 5 bringing it back into the extreme armed condition A, or in proximity of it, when the abutment 7 passes from the locking condition B to the release condition S until the stopping end 5 reaches the stopping condition R intercepting the abutment 7, locking and preventing any possibility of firing up to restoration of the armed condition by the arming mechanism 11.

The arming mechanism 11 consist of a manually actuable knob 29, fixed to the extension 25 of the stem 3 opposite to the stopping end 5

The device 1 may comprise an optional duct that provides flow communication between the cavity of the cylinder 15 and the outside air, such optional duct leading into the end of the chamber 21 opposite to the passing hole 19 for the stem and connecting such chamber 21 with the outside only when the piston 17 is in the armed condition A or in proximity of the latter condition A. Said optional duct can be provided by the opening of a hole through the cylinder wall or by an open and goblet shaped flaring in said wall in the area occupied by the piston when it is at the maximum distance, or almost at said distance, from the passing hole 19 through the stem 3. The optional duct has the purpose of quickly putting the chamber 21 to the external ambient pressure in the armed condition A.

The operation of the device provides that an operator, starting from the locking condition B and the stopping condition R, acts on the knob 29 turning it away, placing the device in the armed condition A, and supports and presses the mouth of the nailer against the piece to nail so translating the movable element 4 and the abutment 7, placing the nailer in the release condition S; at this point, pressing the trigger 6, the operator causes the nail expulsion and the insertion of the same into the piece. This done, the operator can release the trigger and within a time span established by the safety device 1, carry out other nails or, he may, without releasing the trigger, carry out rapid sequences of nailing each caused by the activation of the movable element 4 of the contact safety against the portions to nail. In both cases, after a period of time necessary to the vent hole 23 to evacuate the air in the chamber 21 compressed by the piston 17 by the elastic element 9, the device returns to the stopping condition R in which the nailer is in complete safety.

Figures 5, 6:
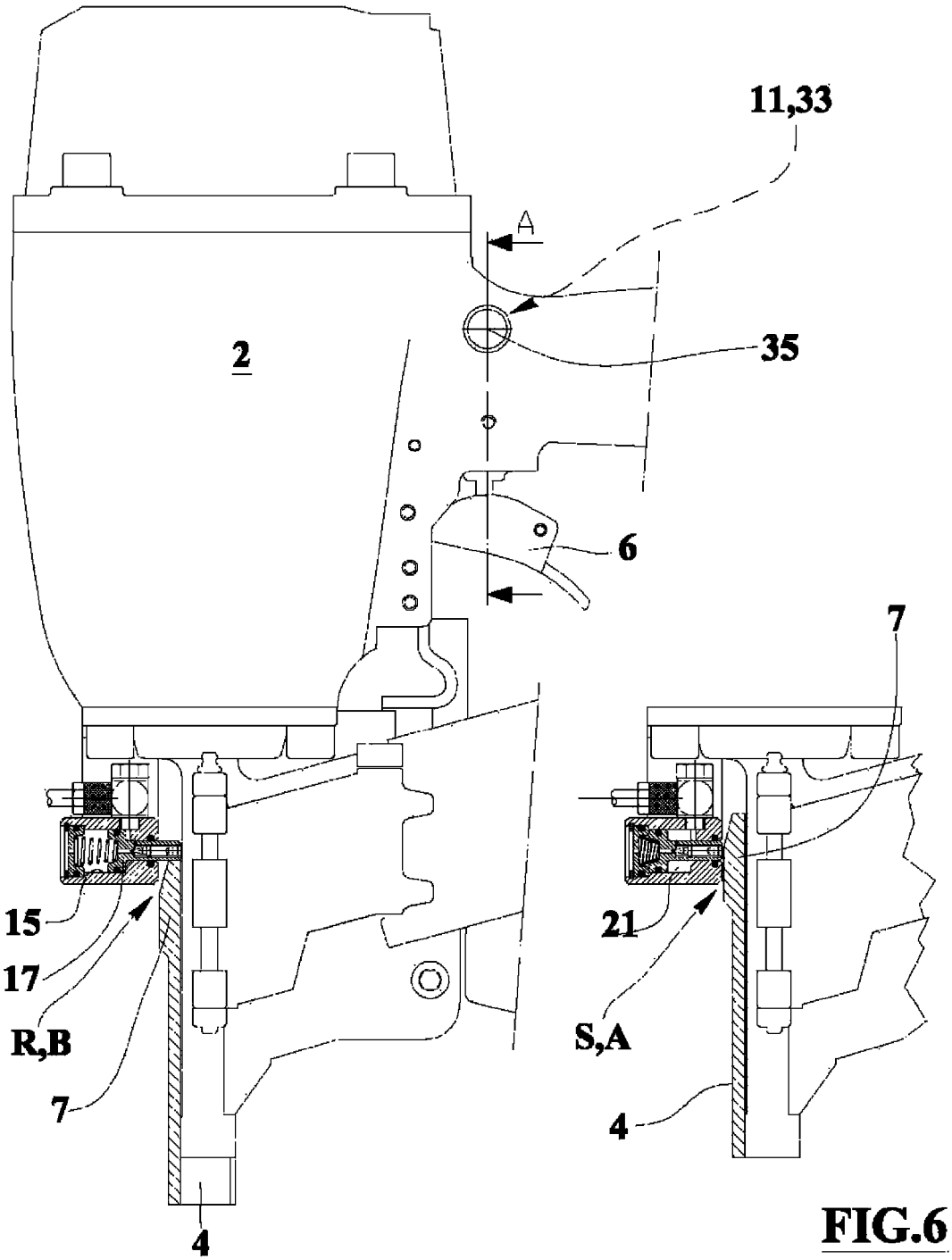
FIGS. 5 and 6 show partials views of a first element of a variant device of FIG. 1 respectively in locking and armed conditions.
Figures 7, 8, 9, 10:
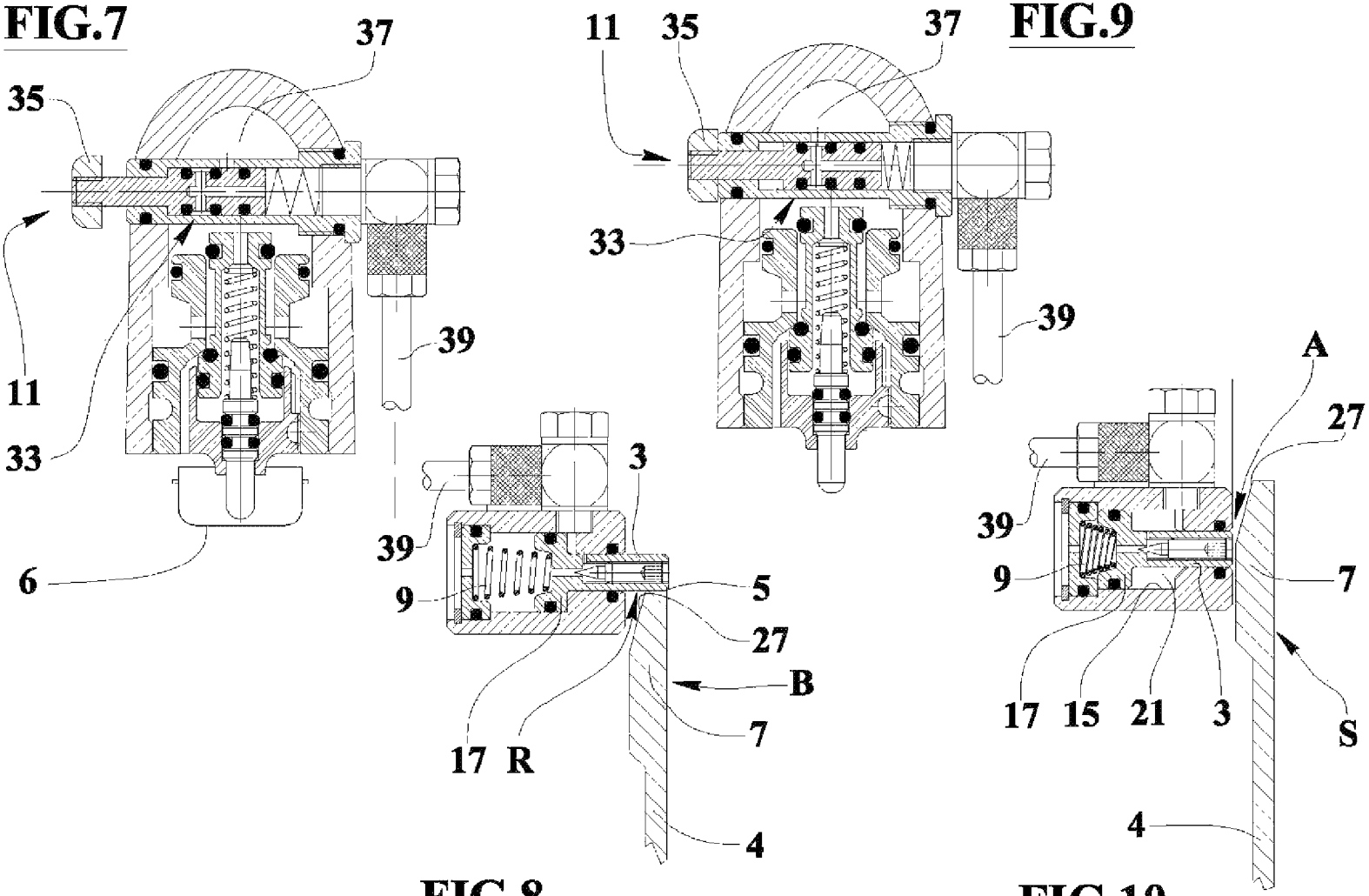
FIG. 7 shows a sectional view according to the plane VII-VII of FIG. 5 of a second element of the variant of FIG. 5.
FIG. 8 shows an enlarged view of the first element of FIG. 5.
FIG. 9 shows a view of the second element of FIG. 7 in an activation condition of the armament of the device.
FIG. 10 shows an enlarged view of the first element of FIG. 6.
Figure 13:
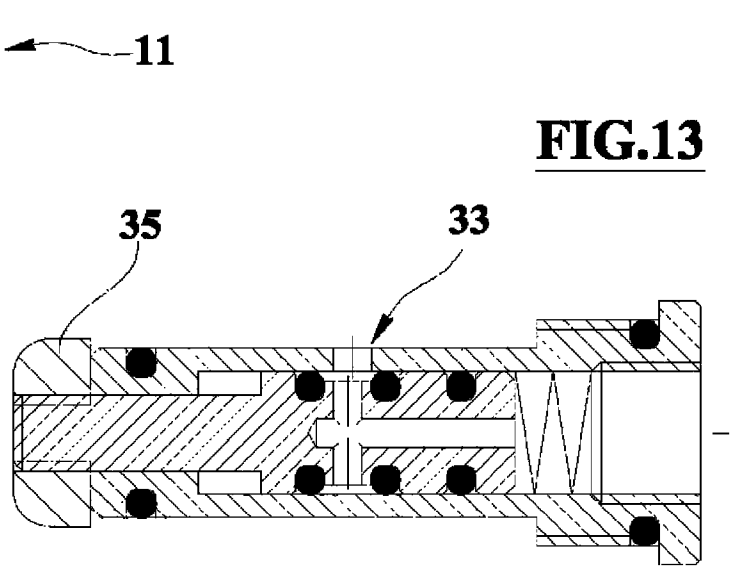
FIG. 13 is an enlarged sectional view of the valve 33 shown in FIG. 9; and, FIG. 14 is an enlarged sectional view of the valve 33 shown in FIG. 10.
Figure 14:
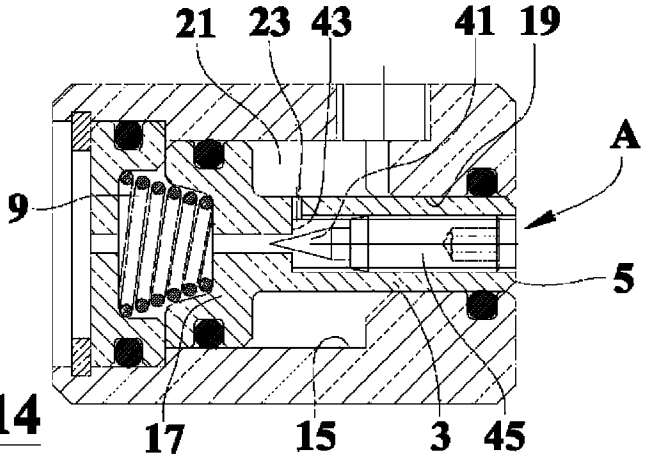
Figure 11:
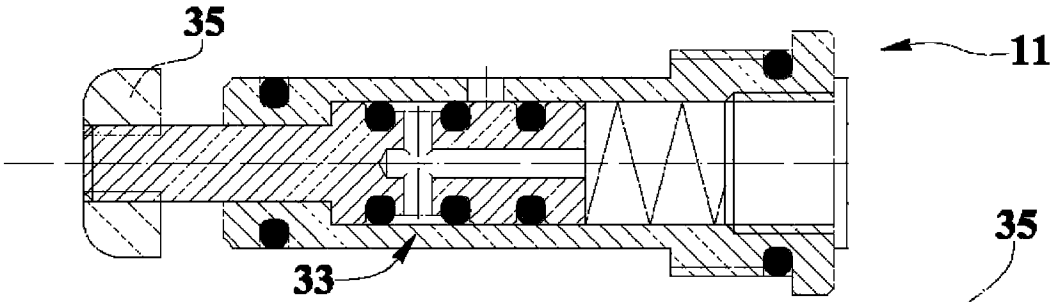
FIG. 11 is an enlarged sectional view of the valve 33 shown in FIG. 7.
Figure 12:
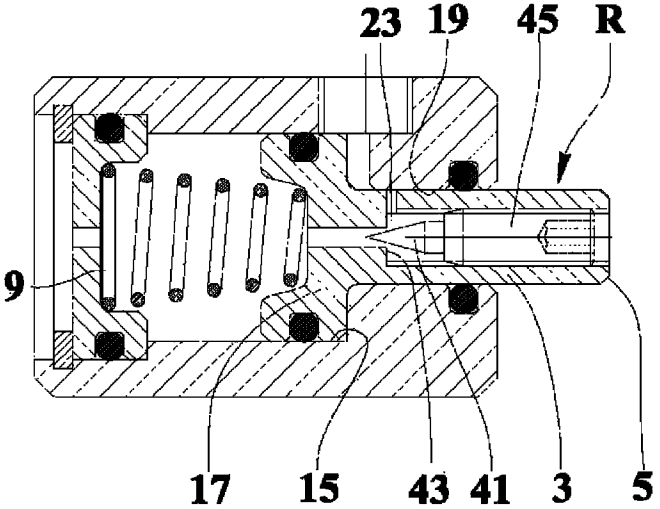
FIG. 12 is an enlarged sectional view of the valve 33 shown in FIG. 8.

The variant of the device 1 illustrated in FIGS. 5 to 14 differs from the previous embodiment in that the arming mechanism 11 comprises a valve 33 controlled by a button 35 to put in flow communication a compressed gas source 37 with the chamber 21 of the cylinder 15 limited between the piston 17 and the end wall having the passing hole 19 through a connecting duct 39.

The connecting duct 39 comprises input and output connections respectively for the opening of the valve 33 and the cylinder 15, a set of joints and rigid or flexible pipes and optionally gas filters, control valve and other pneumatic elements.

The valve 33 comprises a cylindrical cavity whose wall is provided with an opening connected to the compressed gas source 37 and comprises a drawer equipped with radial and axial holes in mutual communication. The seals between the drawer and the wall of the valve cavity are realized through gaskets, for example of O-ring type. A spring elastically maintains the drawer in a position in which the radial hole is spaced from said opening while a pressure on the button, such as to overcome the spring, causes the drawer translation until to the correspondence of the radial hole with the opening. In this condition, the compressed gas is free to flow through the opening, the radial and axial holes and through the connecting duct 39 to the chamber 21.

Therefore the actuation of the button 35 causes the pressure increase in the chamber 21, the translation of the piston 17 and the achievement of the armed condition A.

The valve 33 is associated with the shot organs of the trigger 6 comprising the compressed gas source 37 when the button 35 is of the spring return type and placed on one side of the handle bearing said trigger 6.

The stem 3 and the piston 17 are provided with respective longitudinal through cavities and the vent hole 23 is radially oriented through the side wall of the stem 3 until reaching said pass through the longitudinal cavity and placing the chamber 21 in flow communication with the outside atmosphere.

The through cavity of the stem has a passing pin 41 whose peak is directed toward a shoulder or bottleneck 43 of the vent hole; the base of such pin 41 is supported by a threaded body 45 engaged in a nut screw obtained in the cavity portion of the stem 3 adjacent to the stopping end 5. The shoulder or bottleneck 43, the pin 41, the threaded body, the nut screw and the stem 3 are coaxial. The rotation of the threaded body 45 allows modifying the opening of the vent hole and thus to adjust the time span for returning to the stopping condition R.

The operation of this variant differs from the one described before, for the mere fact that the armed condition A is obtainable by exerting pressure on button 35.

It is important to observe that the device 1 can be originally integrated in the nailer realizing a single apparatus of high security but said device can be separately made, in the form of an additional element to install onto old nailers or anyway nailers not so equipped and not so prearranged for the device application. This device feature allows also the nailers equipped only with the contact safety or without the timer lock provided by the device to reach the highest standards of safety. Both embodiments of the device are fit to reach such safety improvements of nailers devoid of the device itself, for example by the adoption of simple mechanical attachment and, for the second embodiment, by a compressed air connection which allows to detach the valve 33 from the shooting organs and placing the button 35 where more comfortable.

An advantage of the present invention is that it provides a safety device for a nailer that allows the nailer actuation by the trigger only after a specific action on a command of said safety device actuated only by a direct manual intervention of the operator or only after having manually and consciously armed the nailer using the safety device.

Another advantage is that it provides a device able to inhibit the nailer operation after a predetermined time interval spent after the actuation of the safety device itself or from the last actuation of the nailer or rather from the last shot.

A further advantage is that it provides a device that allows performing fast repetition nailing through the safety slide.

Another advantage is that it provides a safety device for arming the nailer by direct manual action on the command of the safety device.

A further advantage is that it provides a safety device for arming the nailer by direct servo assisted action on the command of the safety device.

Another advantage is that it provides a safety device also applicable to not prearranged nailers and old type nailers.

The invention claimed is:

1. A safety device for a nailer having an actuator for expulsion of a fastener in a shooting direction and having a movable element movable between a locking condition where the nailer is inhibited from operation and a release condition where the movable element does not block the nailer making it possible to fire a fastener by actuating a trigger of said nailer, the safety device comprising:

at least one lock having a stopping end movable between a stop condition which interferes with an abutment provided on the movable element, stopping the movable element in said locking condition, and an armed condition where the stopping end allows translation of said abutment, allowing the abutment to reach the release condition;

said lock having an elastic element acting in the direction of the stopping condition and an arming mechanism for acting counter to the elastic element and for shifting the lock and the respective stopping end into the armed condition, such that the arming mechanism is manually actuated to free the abutment from the stopping end to put the nailer in the armed and release conditions, and the movable element is movable into the release condition wherein the nailer is actuatable for shooting the fastener upon action on the trigger;

the abutment consisting of a contact safety lock which moves together with the movable element in a direction parallel to the shooting direction, wherein the lock and the respective stopping end translate along a direction perpendicular or inclined with respect to said firing direction;

a cylinder having a piston slidable in a pneumatically sealed manner therein, the piston fixed to the lock which forms a stein of said piston, the stein slidable in a pneumatically sealed manner through a passing hole formed through an end wall of the cylinder;

a chamber of the cylinder provided with a calibrated or adjustable vent hole that provides flow communication between said chamber and an outside environment; and, the elastic element acting in compression on the piston, or on an extension of the stein opposite to the stopping end.

2. The device according to claim 1 wherein the abutment has an end, a shoulder or a protrusion configured to abut the stopping end when in the stopping condition and has at least an inclined plane surface configured to slidably match with the stopping end for bringing the stopping end back to the armed condition when the abutment passes from the locking condition to the release condition.

3. The device according to claim 1 wherein the vent hole is formed near said end wall having the passing hole or through the end wall or through the stein and further comprising an optional passage that provides flow communication between the cylinder chamber and the outside environment, the optional passage leading to the chamber end opposite to the chamber end having the passing hole, and connects the chamber with the outside environment only when the piston is in the armed condition or almost in the armed condition.

4. The device according to claim 1 wherein the arming mechanism consists of a manually operable knob fixed to the extension of the stein opposite to the stopping end.

5. The device according to claim 1 wherein the arming mechanism comprises a valve controlled by a button for providing flow communication between a compressed gas source and the cylinder chamber, defined between the piston and the end wall having the passing hole, via a connecting duct, where the button actuation causes pressure to increase in the chamber, the piston moved thereby to the armed condition.

6. The device according to claim 5 wherein the valve is associated with firing elements of the trigger, the button having a return spring and being arranged on a side of a handle associated with said trigger.

7. The device according to claim 5 wherein the connecting duct has an input connection, and an output connection respectively for the valve and the cylinder, and at least one joint therebetween, the connecting duct composed of either flexible pipes or rigid ducts, and optionally including a gas filter and/or a control valve.

8. The device according to claim 5 wherein the stein and the piston are provided with respective longitudinal pass through cavities and the vent hole develops along a radial section through a side wall of the stein, and said through cavities between the chamber and the outside environment, the through cavity of the stein having a pin with a tip is directed towards a shoulder or bottleneck of the vent hole and being supported by a threaded body engaged in a nut screw formed in the cavity portion of the stein adjacent to the stopping end where rotation of the threaded body adjusts a time span of a return to the stopping condition.

9. The device according to claim 2 wherein the arming mechanism comprises a valve controlled by a button for providing flow communication between a compressed gas source and the cylinder chamber, defined between the piston and the end wall having the passing hole, via a connecting duct, where the button actuation causes pressure to increase in the chamber, the piston moved thereby to the armed condition.

10. The device according to claim 9 wherein the valve is associated with firing elements of the trigger, the button having a return spring and being arranged on a side of a handle associated with said trigger.

11. The device according to claim 9 wherein the connecting duct has an input connection, and an output connection respectively for the valve and the cylinder, and at least one joint therebetween, the connecting duct composed of either flexible pipes or rigid ducts, and optionally including a gas filter and/or a control valve.

12. The device according to claim 9 wherein the stein and the piston are provided with respective longitudinal pass through cavities and the vent hole develops along a radial section through a side wall of the stein, and said through cavities between the chamber and the outside environment, the through cavity of the stein having a pin with a tip is directed towards a shoulder or bottleneck of the vent hole and being supported by a threaded body engaged in a nut screw formed in the cavity portion of the stein adjacent to the stopping end where rotation of the threaded body adjusts a time span of a return to the stopping condition.

13. The device according to claim 6 wherein the connecting duct has an input connection, and an output connection respectively for the valve and the cylinder, and at least one joint therebetween, the connecting duct composed of either flexible pipes or rigid ducts, and optionally including a gas filter and/or a control valve.

14. The device according to claim 6 wherein the stem and the piston are provided with respective longitudinal pass through cavities and the vent hole develops along a radial section through a side wall of the stem, and said through cavities between the chamber and the outside environment, the through cavity of the stem having a pin with a tip is directed towards a shoulder or bottleneck of the vent hole and being supported by a threaded body engaged in a nut screw formed in the cavity portion of the stem adjacent to the stopping end where rotation of the threaded body adjusts a time span of a return to the stopping condition.

* * * * *